US006519906B2

(12) United States Patent
Yost et al.

(10) Patent No.: US 6,519,906 B2
(45) Date of Patent: Feb. 18, 2003

(54) CORNER ASSEMBLIES FOR CONCRETE FORM PANELS

(75) Inventors: Louis L. Yost, 16365 Falls Rd., Monkton, MD (US) 21111; William R. Yost, 16365 Falls Rd., Monkton, MD (US) 21111

(73) Assignees: Louis L. Yost, Monkton, MD (US); William R. Yost, Monkton, MD (US)

( * ) Notice: Subject to any disclaimer, the term of this patent is extended or adjusted under 35 U.S.C. 154(b) by 0 days.

(21) Appl. No.: 09/850,997

(22) Filed: May 8, 2001

(65) Prior Publication Data

US 2001/0047632 A1 Dec. 6, 2001

Related U.S. Application Data

(63) Continuation-in-part of application No. 09/580,247, filed on May 26, 2000, now Pat. No. 6,240,692.

(51) Int. Cl.[7] ..... E04C 1/00

(52) U.S. Cl. ..... 52/426; 52/309.12; 52/279; 52/564; 52/270; 249/191; 249/18

(58) Field of Search ..... 52/426, 275, 279, 52/564, 712, 713, 699, 442, 378, 379; 249/191

(56) References Cited

U.S. PATENT DOCUMENTS

| | | | | | |
|---|---|---|---|---|---|
| 963,776 | A | * | 7/1910 | Kosack | |
| 2,029,082 | A | * | 1/1936 | Odam | 72/30 |
| 3,722,166 | A | * | 3/1973 | McNerney | 52/720 |
| 3,989,397 | A | * | 11/1976 | Baker | 403/205 |
| 4,177,617 | A | * | 12/1979 | DeLuca et al. | 52/562 |
| 4,766,710 | A | | 8/1988 | Tompkins et al. | 52/278 |
| 4,915,345 | A | * | 4/1990 | Lehmann | 249/18 |
| 5,520,477 | A | * | 5/1996 | Fink | 403/397 |
| 5,564,235 | A | * | 10/1996 | Butler | 52/126.6 |
| 5,570,552 | A | | 11/1996 | Nehring | 52/426 |
| 5,658,483 | A | * | 8/1997 | Boeshart | 249/191 |
| 5,724,784 | A | * | 3/1998 | Menchetti | 52/483.1 |
| 5,782,050 | A | * | 7/1998 | Boeshart | 52/426 |
| 5,845,488 | A | | 12/1998 | Potvin | 52/426 X |
| 5,887,401 | A | | 3/1999 | Moore, Jr. | 52/426 |
| 5,992,114 | A | * | 11/1999 | Zelinsky et al. | 52/426 |
| 6,250,033 | B1 | * | 6/2001 | Zelinsky | 52/275 |
| 6,324,804 | B1 | * | 12/2001 | Hoogstraten | 52/426 |

FOREIGN PATENT DOCUMENTS

| | | | |
|---|---|---|---|
| BE | 541742 | 10/1955 | 52/426 |
| IT | 411591 | 2/1945 | 52/426 |
| SE | 175441 | 2/1945 | 52/426 |

* cited by examiner

*Primary Examiner*—Carl D. Friedman
*Assistant Examiner*—Basil Katcheves
(74) *Attorney, Agent, or Firm*—Armstrong, Westerman & Hattori, LLP

(57) ABSTRACT

A corner assembly for concrete form panels has a pair of rigid members. Each member has a bend therein to form a selected dihedral angle. The members are spaced apart by a selected distance and a removable bridge is disposed between the pair of rigid members. At least one concrete panel form is juxtapositioned to and connected to each of the rigid members. One of the rigid members is disposed exteriorly of the at least one concrete panel form. Concrete is disposed interiorly of the at least one concrete panel form. The corner assembly is adjustable to provide support for the corner of the construction.

21 Claims, 8 Drawing Sheets

CORNER ASSEMBLIES FOR CONCRETE FORM PANELS

CROSS REFERENCE TO RELATED APPLICATIONS

The present application is a continuation-in-part of U.S. application Ser. No. 09/580,247 filed May 26, 2000 now U.S. Pat. No. 6,240,692, which is incorporated in its entirety by reference hereto.

FIELD OF THE INVENTION

The present invention is directed to a concrete form assembly of panels which are spaced apart to form walls into which concrete is poured for construction purposes. More particularly, the present invention is directed to corner assemblies to support the panels.

BACKGROUND OF THE INVENTION

It is known that insulated polystyrene panels may be joined together to form walls which are interconnected with bridges so that two parallel walls are formed into which concrete may be poured for construction purposes. The parent application discloses prior art related to the blocks, inserts and bridges used in the construction of walls to retain the concrete.

The prior art has habitually resorted to the use of molded polystyrene corner pieces which, unfortunately, do not have the desired rigidity, strength and dimensional stability. The expanded needs to shrink or keep over time, especially during adverse weather conditions in storage. Nor can their respective dihedral angles be quickly changed without requiring the production of new molds, which is time consuming and expensive.

During this type of construction, it has been found that the weakest structural features occur at the corners where panels are disposed at angles to one another. The internal bracing does not fully support the forces of pressure applied to the corners when concrete is poured. It is frequently necessary to provide external bracing to the corners to prevent sag, deformation, separation or blow-out of the panels at the corners.

Holman, in U.S. Pat. No. 878,000, used two sides between which concrete was poured.

Corner braces were employed to connect the two sides at the corners. In U.S. Pat. No. 1,240,436, Gendron et al formed two concrete walls with a hollow space between the walls. Sheet metal corner abutments were used at the interior corners of the hollow space between the walls. Boeshart in U.S. Pat. Nos. 4,916,879; 5,658,483 and 5,782,050 discloses corner ties for walls made with foam panels and concrete. The corner ties are marketed as FOLD FORM® and are sold by Fold Form, Inc., Sioux City, Iowa. The product is a molded plastic web with limited support external of the panels. The product is restricted to the dimensions provided and has no versatility to be adapted to various angles for the corner or varying spacing between the panel walls if the concrete portion of the wall is to have a greater or lesser thickness than preset in the product. A separate form is required if the corner angle or thickness of the concrete is varied. The product is disposed between two vertically abutting panels and the edges of the panels each must be provided with specially cut slots to receive straps in the product.

There is a need for a versatile corner support which is usable for varying angles of corners and varying thicknesses of concrete wall. The corner support must be capable of being used with no, or only minimal, adaptation of the panels. The corner support must provide sufficient support as to avoid the necessity for exterior bracing and to prevent sag, separation or blow-out of the corner when concrete is introduced.

BRIEF SUMMARY OF THE INVENTION

It is an object of the present invention to provide a corner system which is versatile and can be used with varying corner angles and varying thicknesses of concrete.

It is another object of the present invention to provide a corner system which fully supports the form panels without further aids and avoids sag, deformation, separation and blow-out of the corners.

In accordance with the teachings of the present invention, there is disclosed a corner assembly for concrete form panels having a pair of rigid members. Each member has an inner face and a bend therein forming a selected dihedral angle. The rigid members are spaced apart by a selected distance. A removable bridge is disposed between the pair of rigid members. At least one concrete panel form is juxtapositioned, and connected to the respective inner face of each of the rigid members and concrete is disposed adjacent to each of the at least one concrete form panel. The corner assembly retains the concrete form panel without internal bracing and without risk of sag, deformation, separation or blow-out of the corner assembly.

In further accordance with the teachings of the present invention, there is disclosed a form for concrete construction having the combination of two pairs of concrete form panels spaced apart a preselected distance, including an inner pair and an outer pair disposed radially therefrom. Each pair includes a pair of concrete form panels disposed in an angular relationship with respect to each other and forming a respective dihedral angle therebetween. At least one bent sheet metal reinforcing member is disposed exteriorly of the other pair of concrete form panels and abutting thereto, thereby forming a secure corner assembly such that the concrete may be poured into the space between the two pairs of concrete form panels without risking a sag, separation or blow-out of the corner assembly nor requiring external bracing thereto.

In still further accordance with the teachings of the present invention, there is disclosed a form assembly used for concrete construction, wherein the concrete is poured between spaced-apart plastic form panels. The form panels are retained during the pouring of the concrete. The improvement is a metal corner assembly having two pairs of metal members spaced apart a preselected distance, including an inner pair and an outer pair of bent sheet metal members. Each pair of bent sheet metal members includes a first metal member and a second metal member, such that plastic form panels may be received within the respective first and second metal members and retained thereby during the pouring of the concrete into the space between the respective pairs of metal members.

Additionally, there is disclosed a corner assembly for concrete form panels having a pair of rigid members. Each member has an inner face and a bend therein forming a selected dihedral angle. The rigid members are spaced apart by a selected distance. A plurality of spaced-apart tie-in openings are formed in the rigid members. At least one concrete panel form is juxtapositioned to each of the rigid members. At least one elongated shank is received in at least one of the tie-in openings and extends therethrough into the at least one concrete form panel to secure the rigid member to the at least one concrete form panel. Concrete is disposed adjacent to each of the at least one concrete form panels. The corner assembly retains the concrete form panel without external bracing and without risk of sag, deformation, separation or blow-out of the corner assembly.

There is further disclosed a corner assembly for concrete form panels having a pair of rigid members. Each member has an inner face and a bend therein forming a selected dihedral angle. The rigid members are spaced part by a selected distance. A foot plate is disposed at the base of the corner assembly and connected substantially perpendicularly to the corner assembly to serve as a pivot point for adjusting the corner assembly. At least one concrete panel form is juxtapositioned, and connected to each of the rigid members and concrete disposed adjacent to each of the at least one concrete form panels. The corner assembly retains the concrete form panel without external bracing and without risk of sag, deformation, separation or blow-out of the corner assembly.

In still another aspect, there is disclosed the method of constructing at least one pair of intersecting concrete walls, between respective spaced-apart pairs of form panels, wherein the concrete poured between the respective pairs of form panels creates a stress concentration at the corner, thereby tending to blow out the corner during pouring of the concrete, and thereby requiring external bracing to prevent a blow out at the corner as the concrete is being poured the improvement comprises the step of providing at least one bent sheet metal reinforcement for the form panels at the intersecting corner therebetween, such that the bent sheet metal reinforcement has a dihedral angle that may be selected easily and conveniently without incurring substantial mold charges. In this manner, the external bracing may be minimized or eliminated altogether. The bent sheet metal reinforcement may have any desired height to accommodate a single corner or a plurality of corners spaced vertically with respect to each other.

In another aspect there is disclosed a method of concrete construction. A plurality of form panels are provided. A corner assembly is provided having at least one member having a bend therein forming a selected dihedral angle. Two of the form panels are disposed at the selected dihedral angle with respect to one another, the form panels being juxtapositioned to the corner assembly. Concrete is disposed against the two form panels wherein the at least one member of the corner assembly is distal from the concrete and retains the form panels at the selected dihedral angle without external bracing and without risk of sag, deformation, separation or blow-out of the corner assembly.

Accordingly, it is the primary object of the present invention to provide the optimum combination of plastic and metal to quickly and economically produce a variety of corner assemblies having the desired rigidity, strength and dimensional stability consonant with relatively low cost and minimum tooling instruments.

These metal corners are quite strong, and thus the external bracing requirements are minimized if not eliminated altogether.

Moreover, contractors who are even minimally familiar with concrete construction (using the expanded forms) will readily appreciate the inherent features and advantages of the corner assemblies of the present invention without requiring demonstrations and an educational process, other substantially reducing initial marketing costs.

These and other objects of the present invention will become apparent from a reading of the following specification taken in conjunction with the enclosed drawings.

DESCRIPTION OF THE PREFERRED EMBODIMENTS

In the construction of a building using the insulated polystyrene panels to form two parallel walls with concrete between the panels, problems arise at the corners of the walls. In the present state-of-the-art construction procedures, two panels formed from expanded polystyrene block are butted together to form the desired angle. In some instances, external bracing is needed at the corners before the concrete is poured and the bracing is removed when the concrete has set. This is a time consuming, labor intensive, costly procedure. The device of U.S. Pat. No. 4,916,879 has been marketed to address this problem but has the limitations discussed previously.

Figure 1:
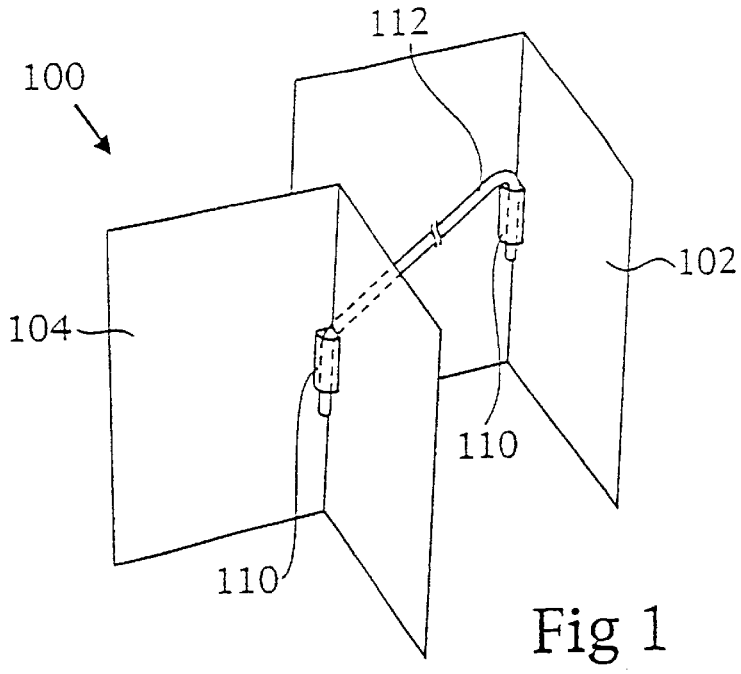
FIG. 1 is a perspective view of one embodiment of the present invention showing two connected corner members forming a corner assembly.

The present invention recognizes these problems and provides a solution. Corner assemblies 100 are formed from a pair of complementary members 102, 104, each member having an inner face and being bent at a selected dihedral angle (FIG. 1). Preferably, the members 102, 104 are bent at an angle of 90° but the bend could be at other angles depending upon the construction required. The members 102, 104 are formed from a rigid material. Preferably, the rigid material is sheet metal but plastic having sufficient rigidity may be used. If the material is metal, galvanized iron is preferred. The thickness of the members 102, 104 is selected based on the specific requirements of the construction. Although not limited, a thickness of 24–28 gauge is preferred. The first member 102 is adjustably connected to the second member 104 by means which will be described. At least one concrete form panel 106 is disposed adjacent to each member 102, 104 of the pair such that the respective ends 106 of the concrete form panels above placed at a dihedral angle with respect to each other which corresponds to the angle at which the members 102, 104 are bent. In most construction, the angle is 90°, but for some uses, acute and/or obtuse angles may be required.

Figure 2:
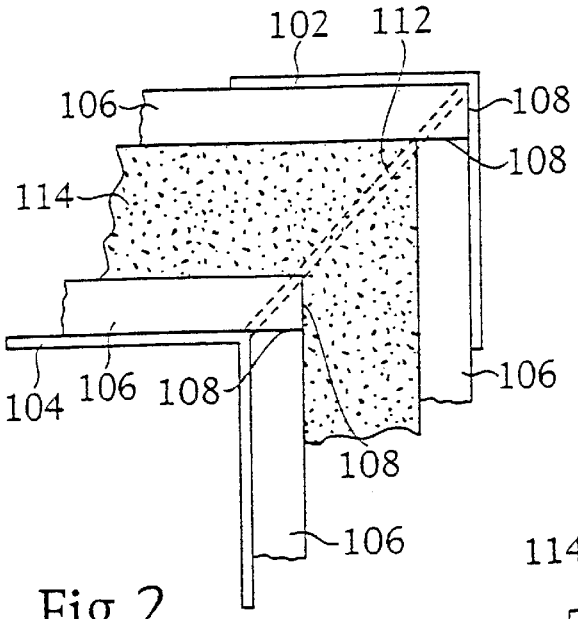
FIG. 2 is a top plan view showing form panels disposed adjacent to each of the corner members with concrete disposed therebetween.

Referring to FIG. 2, the first member 102 is spaced apart from the second member 104 by a distance dependent upon the thickness of the concrete and of the panels which is required for the construction. Each member 102, 104 has at least one inwardly lanced-out eyelet 110 formed internally at the bend of the respective member.

A tie rod 112, preferably in the shape of an inverted U-shaped bridge, is disposed between the members 102, 104 and has right angle bends therein defining a length. The length corresponds to the distance required between the members and can be made at the construction site or can be preformed to provide versatility and flexibility to the system. The ends of the bridge 112 are bent at right angles and are received in the inwardly lanced-out eyelets 110 in the respective members 102, 104 to connect the outer side of the second member 104 to the inner side of the first member. The lanced-out eyelets 110 are formed so that the members 102, 104 may be connected by the bridge 112 even when the members 102, 104 are inverted with respect to one another.

Figure 3:
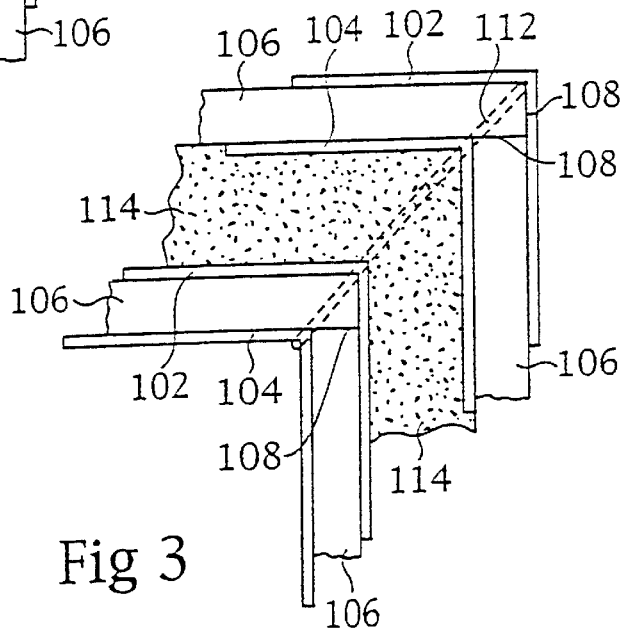
FIG. 3 is a top plan view showing two corner assemblies with form panels disposed in each corner assembly and concrete disposed between the two corner assemblies.
Figure 7:
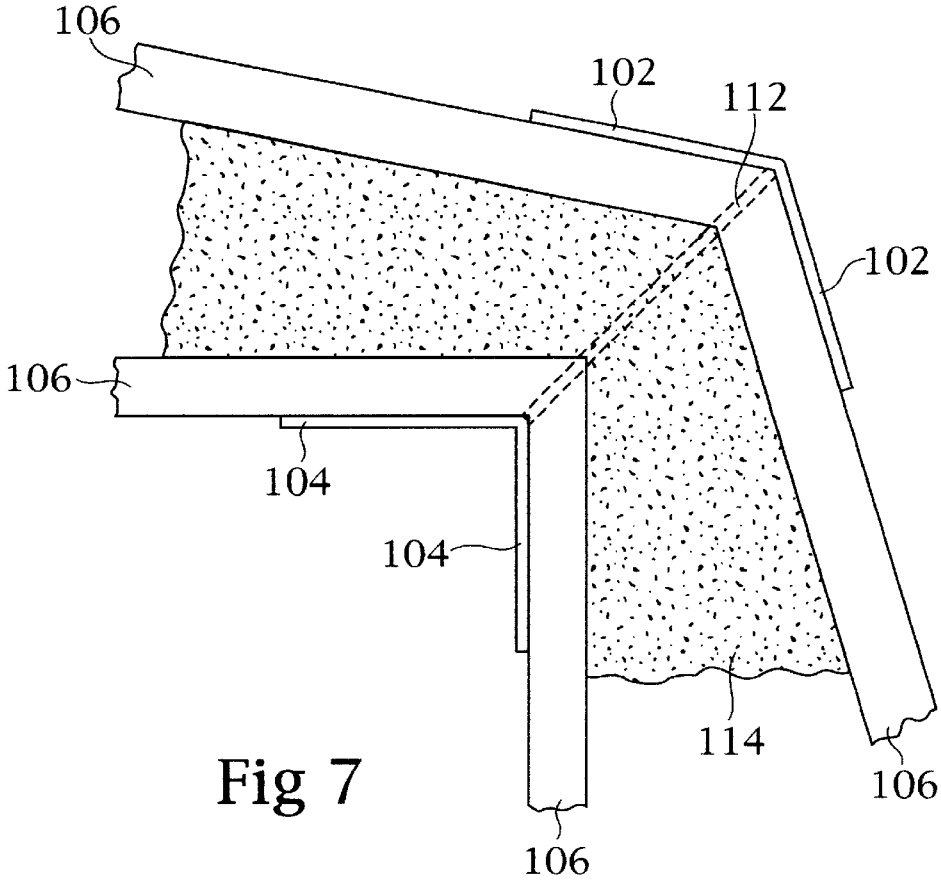
FIG. 7 is a top plan view showing the dihedral angle of the first pair of members at a different dihedral angle from the second pair of members.

As shown in FIG. 3, two corner assemblies, each consisting of a pair of members 102, 104 are combined to form an overall corner assembly. An inner pair of members 102, 104 is spaced apart from an outer pair of members. Concrete form panels 106 are juxtapositioned to the inner face of each member 102 of each pair with the respective ends 108 of the form panels 106 at an angle corresponding to the angle of the member 102, 104. The inner face of a member is defined herein as the face of the respective member which is opposite and proximal to the other member. The outer face of a member is the face which is the inverse of the inner face and is distal from the other member. The term "exterior" as used herein is defined as the portion of the construction which is viewed from the outside of the construction. The exterior corresponds to the largest surface area of the corner which is exposed to hydraulic forces of the concrete and where support is most necessary. The term "interior" as used herein is defined as the portion of the construction which is viewed from within the building or construction. Depending upon the construction requirements, the dihedral angle of the first member may be different from the dihedral angle of the second member (FIG. 7). The individual assemblies, each having members 102, 104 are connected by the tie rod 112 and concrete 114 is poured between the concrete form panels 10.

Figure 4:
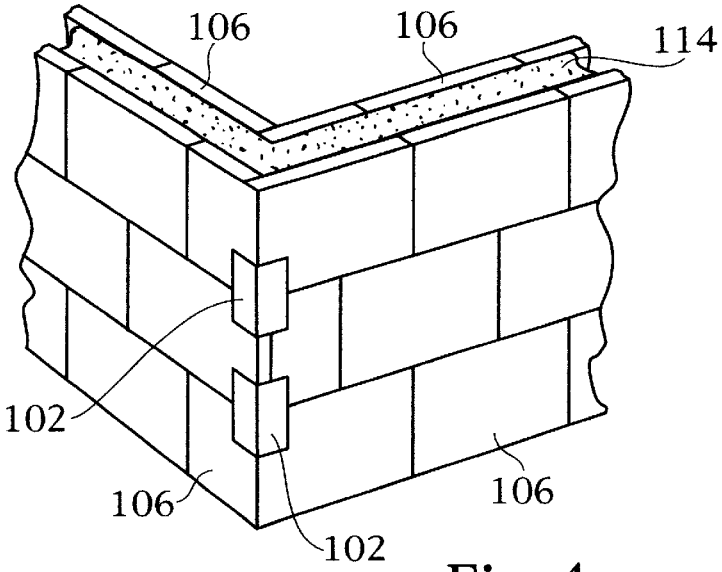
FIG. 4 is a perspective view of the outside of a wall having the corner assembly of the present invention disposed therein.

FIG. 4 shows the present invention disposed in the corner of a wall formed of concrete form panels 106. The size of the bent member 102 of the corner assembly 100 is such that adequate support is provided to the wall and may be selected depending upon the specific requirements. It is preferred that each member 102 have a height of approximately six (6) inches and each bent portion have a width of approximately five (5) inches although these dimensions may be varied. The members may have widths which are different from each other such that the member has an "L" shape. In most instances, it may be desirable for each member to have a height of up to eight (8) or more feet. The corner assemblies 100 may be spaced apart vertically or butted together to provide a corner assembly of any desired height.

Figure 5:
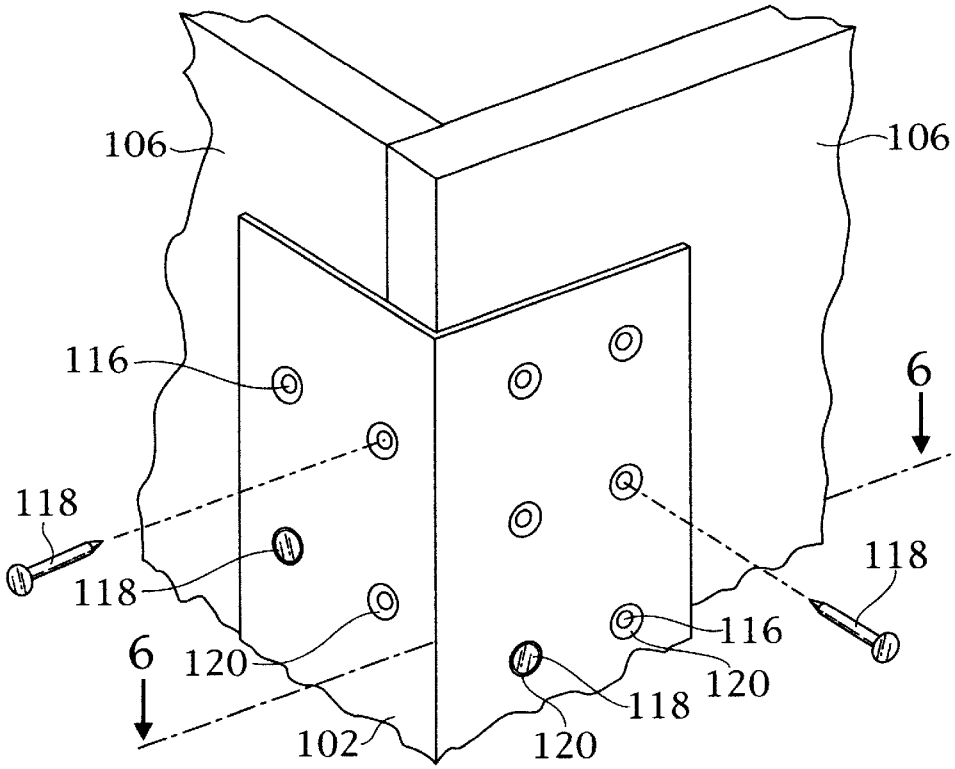
FIG. 5 is a perspective view of the corner assembly connected to the form panel by the elongated shank.
Figure 6:
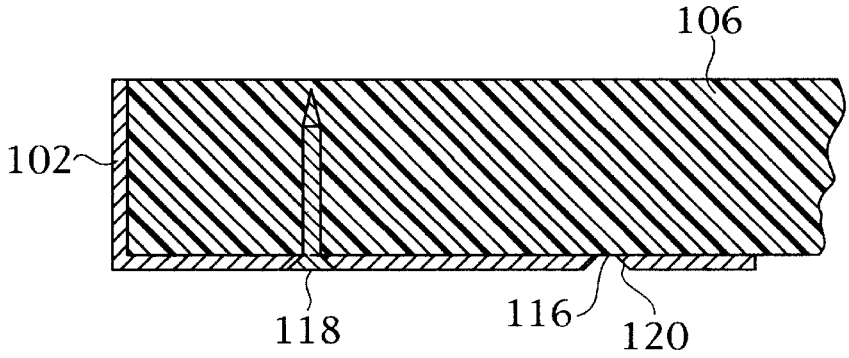
FIG. 6 is a cross-sectional view taken across the lines 6—6 of FIG. 5.

A plurality of spaced-apart tie-in openings 116 are formed in the faces of each of the rigid members 102, 104 (FIGS. 5 and 6). At least one elongated shank 118 is disposed in at least one of the tie-in openings in each rigid member. The elongated shank 118 extends through the respective member 102, 104 and into the adjacent polystyrene concrete form panel 106 to connect the respective member to the form panel 106 and minimize any movement between the corner assembly 100 and the adjacent form panel 106. Preferably, the elongated shank 118 has a sharpened end and a head at an opposite end. The sharpened end is lodged within the form panel 106 and the head is disposed exteriorly of the member 102, 104 wherein the tie-in opening is countersunk 120 so that the head of the shank 118 is substantially flush with the plane of the member 102, 104. The elongated shank 118 may be a nail, a spike, a screw, a rod or other means known to persons skilled in the art. The tie-in openings 116 are disposed in the members 102, 104 such that the shanks 118 in one portion of the member do not interfere with or contact the shank in the angled other portion of the member when the respective shanks 118 are lodged within the adjacent form panels 106. It is preferred that the shanks 118 be "toed-in" to lock the panels 106 to the corner assemblies 100. The length of the shank 118 is not critical. The shank 118 may terminate within the panel 106 or may extend completely through the panel 106 and terminate within the cavity in which the concrete is placed. If the shank so extends, it further anchors the corner assembly. The number of shanks 118 to be used are determined by the nature of the specific construction. It is preferred that all of the embodiments of the rigid members have the plurality of spaced-apart tie-in openings 116 formed therein.

It is also preferred that at least a portion of an outer face of the corner assembly 100 be colored wherein it is readily apparent where the corner assemblies have been installed. Any color may be used. The color may be preformed or the color may be applied by any means known to persons skilled in the art.

Figure 8:
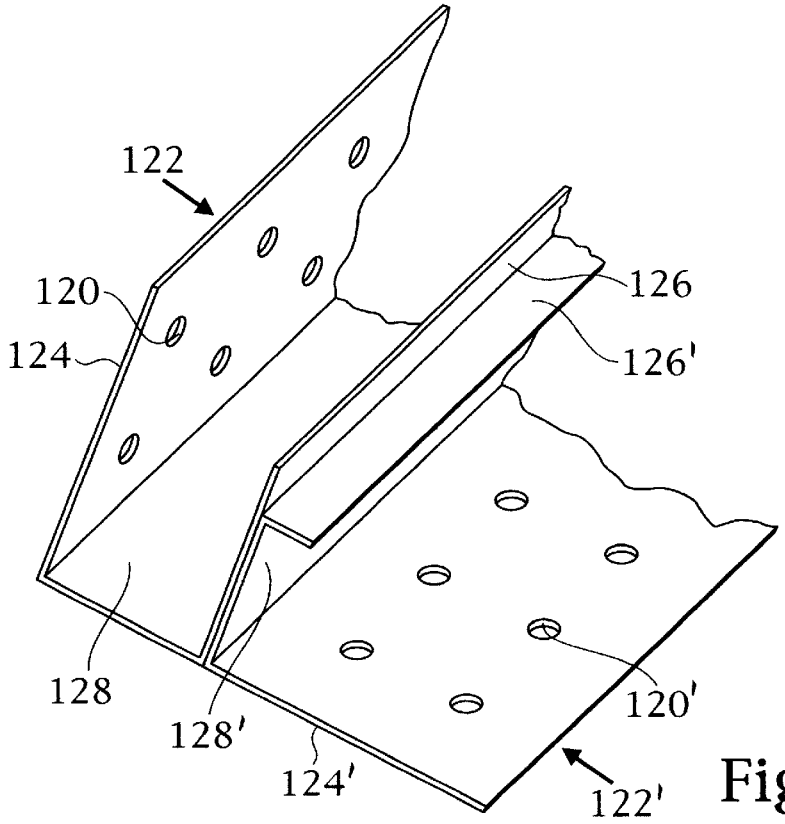
FIG. 8 is a perspective view of an alternate embodiment which has two J-shaped members.
Figure 9:
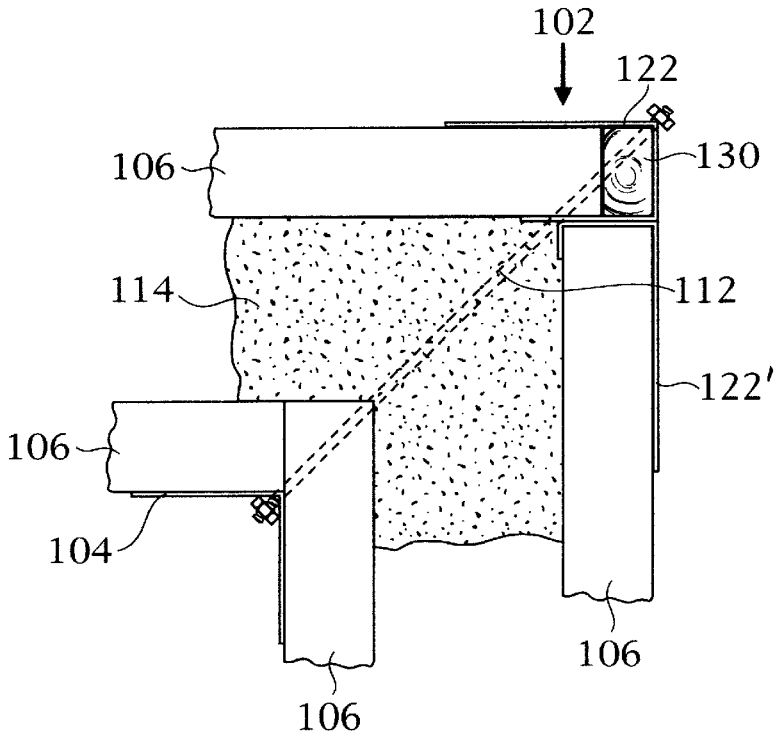
FIG. 9 is a top plan view showing a corner assembly having two connected J-shaped members with concrete form panels and concrete received therein.
Figure 10:
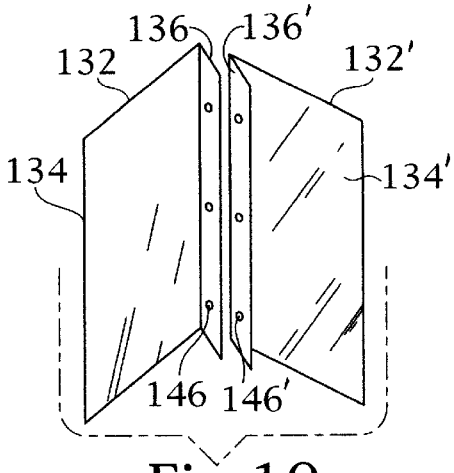
FIG. 10 is a perspective view of two submembers of a first member of the corner assembly.
Figure 11:
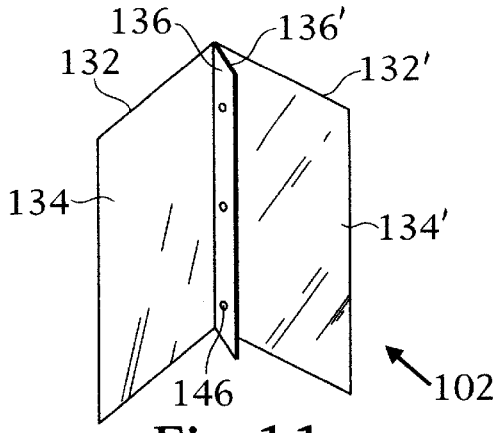
FIG. 11 is a perspective view showing the two submembers of FIG. 10 mated.
Figure 12:
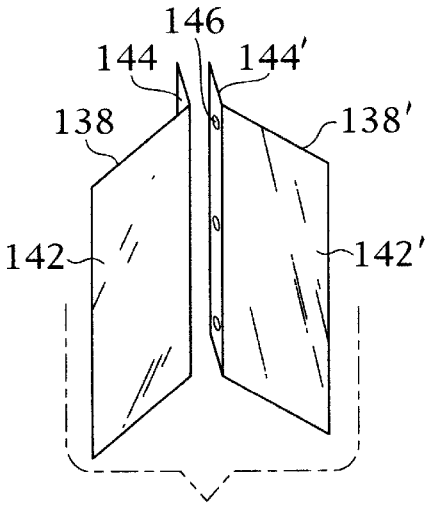
FIG. 12 is a perspective view of two submembers of a second member of the corner assembly.
Figure 13:
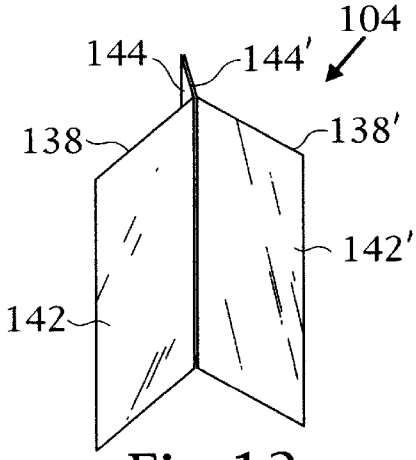
FIG. 13 is a perspective view showing the two submembers of FIG. 12 mated.
Figure 14:
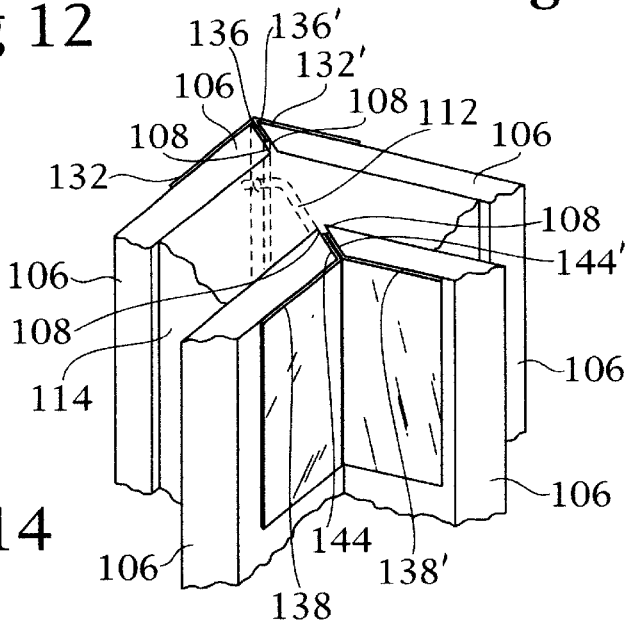
FIG. 14 is a top plan view showing the submembers of FIGS. 11 and 13 supporting concrete form panels and concrete therebetween.

In another embodiment (FIG. 8) the first member 102 is formed from submembers. Each submember 122 has a "J" shape. One submember 122 has a long leg 124, a short leg 126 and a base 128 therebetween. The one submember is disposed with the long leg 124 exteriorly and the base 128 forming a right angle at the corner. The base 128' of the other submember 122' is abutted and connected to the short leg 126 of the one submember, the long leg 124' of the other submember 122' being substantially flush with the base 128 of the one submember 122. The connection between the submembers 122, 122' may be nut and bolt, welding, riveting, adhesive or any means known to persons skilled in the art. A concrete form panel 106 is received between the legs 124, 126 of one of the submembers and another of the concrete form panels 106 is received between the legs 124', 126' of the other submember 122' (FIG. 9). Spaced apart from the first member 102, at a preselected distance, is the second member 104 of the corner assembly 100. The second member 104 may be similar to the first member 102 but may also be a right angle section of metal of a necessary length as will be described.

Figure 16:
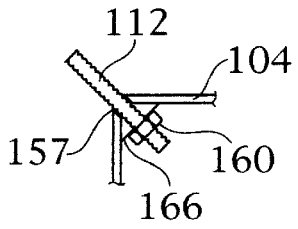
FIG. 16 is a perspective view of the end of the threaded bridge connected to the second member with a fastener and wedging the shelf in place.

A bridge or tie rod 112 is removably connected to the first member 102 and the second member 104 to minimize movement between the members and also to maintain spacing between the members 102, 104. The bridge 112 has a length which is adjusted to provide a desired thickness of concrete which is poured between the form panels 106 adjacent to the first member 102 and the second member 104. The bridge 112 may have ends which are bent to be received in openings in the first 102 and second 104 members. Alternately, the bridge 112 may be threaded and have cooperating nuts, sleeves or other means to adjust the length and to secure the bridge 112 of respective openings in the first member 102 and the second member 104 (FIG. 16).

With the alternate embodiment having "J" shaped submembers 122, 122', preferably a supporting means 130 is disposed vertically within the corner assembly 100 to provide vertical support to the corner assembly 100. As shown in FIG. 9, the supporting means 130 may be a wooden or metal beam, preferably having a length of several feet and extending vertically in support of a plurality of concrete form panels and a plurality of corner assemblies. A plurality of support means 130 may be abutted end to end to provide vertical support to a wall which has a height of many feet. If the support means 130 is formed from wood, it can also serve as an additional nailing flange for the corner assembly.

In another embodiment as shown in FIGS. 10–14, the first rigid member 102 is formed from a first submember 132 and a second submember 132'. Each submember has a longer side 134, 134' and a shorter side 136, 136', there being a 45° angle between the longer side 134, 134' and the shorter side 136, 136'. The shorter sides 136, 136' of the submembers abut and connect to one another such that the longer sides 134, 134' form a 90° outer corner. A first concrete panel form 106 having a side formed at a 45° angle is disposed adjacent to the 45° angle of the first submember 132, a second concrete form panel 106 having a side formed at a 45° angle is disposed adjacent and side-by-side to the 45° angle of the second submember 132' such that the 45° angle sides of the first concrete form panel 106 cooperate with the 45° angle side of the second concrete form panel 106. The concrete form panels 106 are disposed perpendicular to one another interiorly of the longer sides 134, 134' of the respective submembers 132, 132'. The second rigid member 104 is formed from a first submember 138 and a second submember 138'. Each submember 138, 138' has a longer side 142, 142' and a shorter side 144, 144', there being a 135° angle between the longer side 142, 142' and the shorter side 144, 144'. The shorter sides 144, 144' of the submembers 138, 138' abut and connect to one another. The longer sides 142, 142' form a 90° inner corner. A first concrete form panel 106 having a side formed at a 135° angle is disposed adjacent to the 135° angle of the first submember 138, a second concrete form panel 106 having a side formed at a 135° is disposed adjacent to the 135° angle of the second submember 142' such that the respective 135° angle side of the first concrete panel form cooperates with the 135° angle side of the second concrete panel form. The concrete panel forms are disposed perpendicularly to one another. Angles of 45° and 135° are provided as operative examples. The angles could vary depending upon specific construction requirements where the corners are not formed at 90°. The second rigid member 104 is spaced apart from the first rigid member 102 by a selected distance. The shorter sides 136, 136' of the first rigid member 102 and the shorter sides 144, 144' of the second rigid member 104 have respective openings formed therein. At least one bridge 112 having bent ends and a length corresponding to the distance between the spaced-apart first 102 and second 104 rigid members, is removably disposed between the first 102 and second rigid members 104. The bent ends of the at least one bridge 112 are received in openings 146, 146' in the shorter sides 136, 144 of the respective rigid members 102, 104 such that the first rigid member 102 is connected to the second rigid member 104. Concrete 114 is disposed between the respective concrete form panels 106 adjacent to the first rigid member 102 and the second rigid member 104.

Figure 15:
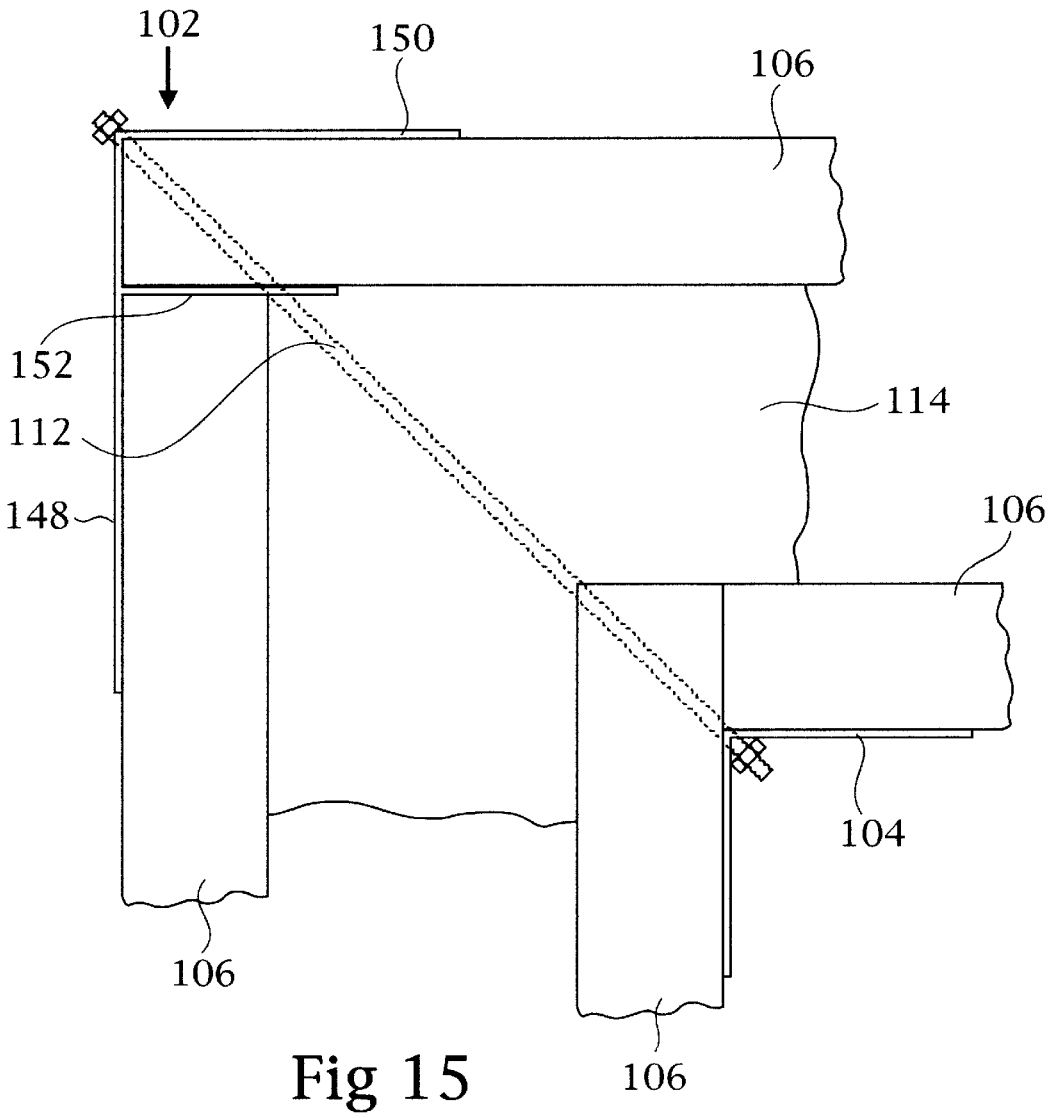
FIG. 15 is a top plan view showing an F-shaped member with concrete form panels adjacent to the member.

In still a further embodiment (FIG. 15), the first rigid member 102 has a leg 148 to which are connected at right angles, an upper arm 150 and an intermediate arm 152 defining a "F" shape. A first concrete form panel 106 is disposed between the upper arm 150 and the intermediate arm 152. A second concrete form panel 106 is disposed parallel to the leg 148, abutting a lower surface of the intermediate arm 152. The second rigid member 104 is spaced apart from the first rigid member 102 by a selected distance and concrete form panels 106 are disposed adjacent to the second rigid member 104. At least one bridge 112 is removably connected between the first rigid member 102 and the second rigid member 104. The length of the bridge 112 corresponds to the selected distance between the first member 102 and the second member 104. Concrete 114 is disposed between the respective concrete form panels 106 adjacent to the first rigid member 102 and the second rigid member 104.

The second member 104 of the corner assembly 100 preferably has a plurality of openings 157 formed therein. The openings 157 are formed at the bend of the second member 104 and are spaced apart vertically at periodic intervals. Tie-in openings 116 are formed on the submembers at periodic intervals. The bridges 112 between the first member 102 and the second member 104 are received in the selected openings 157 at the bend in the second member 104 and protrude inwardly. A fastening means 160 is threadingly received on the bridge 112 and is tightened to secure the members 102, 104. A plurality of shanks 118 may be inserted through the tie-in openings 116 and into the concrete form panels 106 as previously described.

Figure 17:
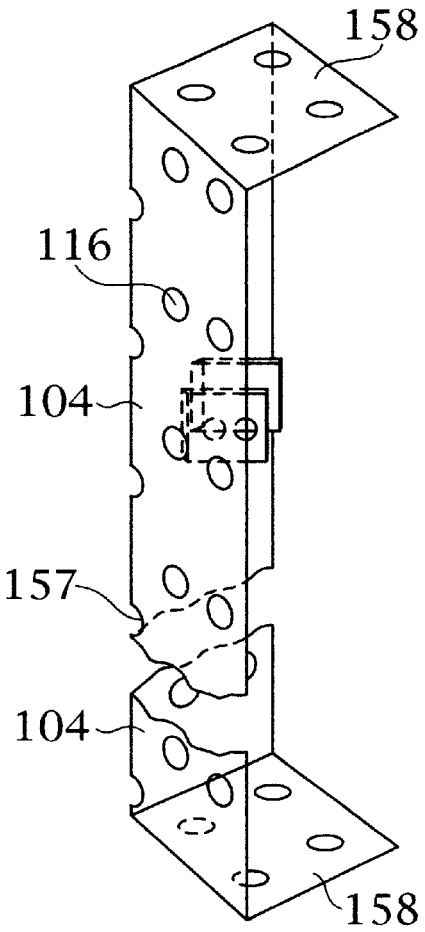
FIG. 17 is a perspective view showing the second member having a foot plate and a clip.
Figure 18:
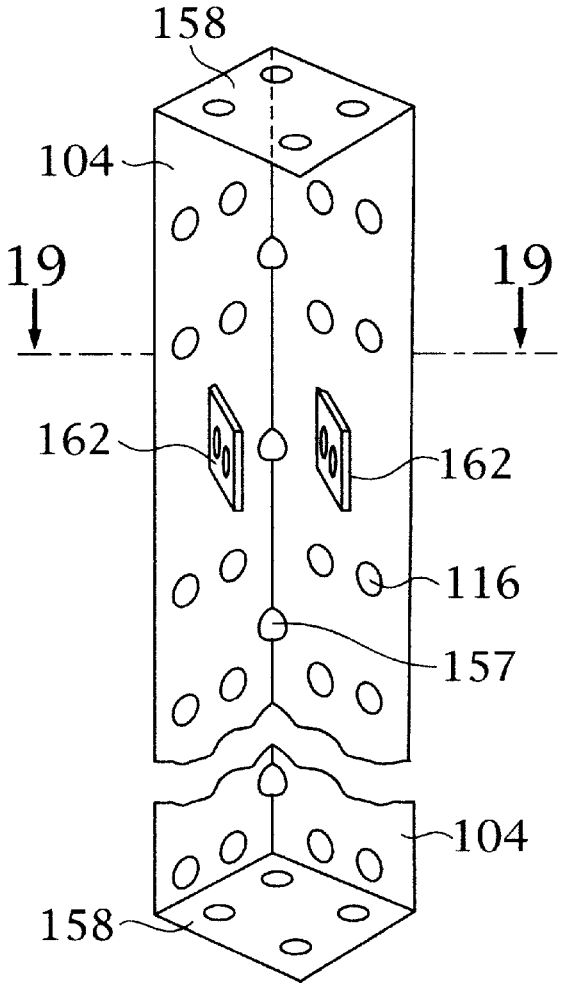
FIG. 18 is a perspective view of the inside of the right angle second member showing the foot plate, shelves and clip.
Figure 19:
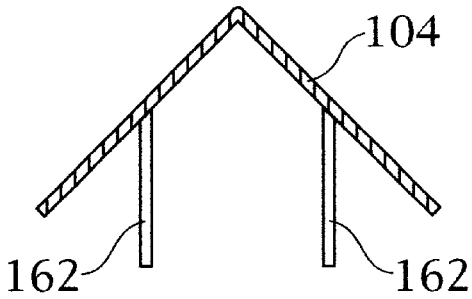
FIG. 19 is a cross-section view taken across the lines 18—18 of FIG. 17.
Figure 20:
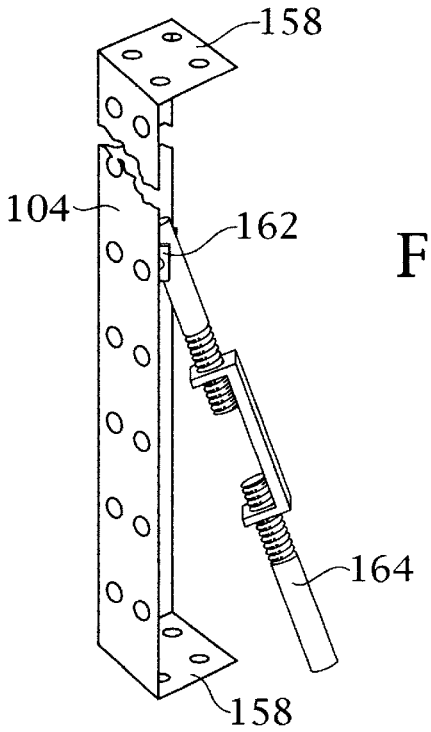
FIG. 20 is a perspective view of an adjustable brace received in the clip on the second member.
Figure 21:
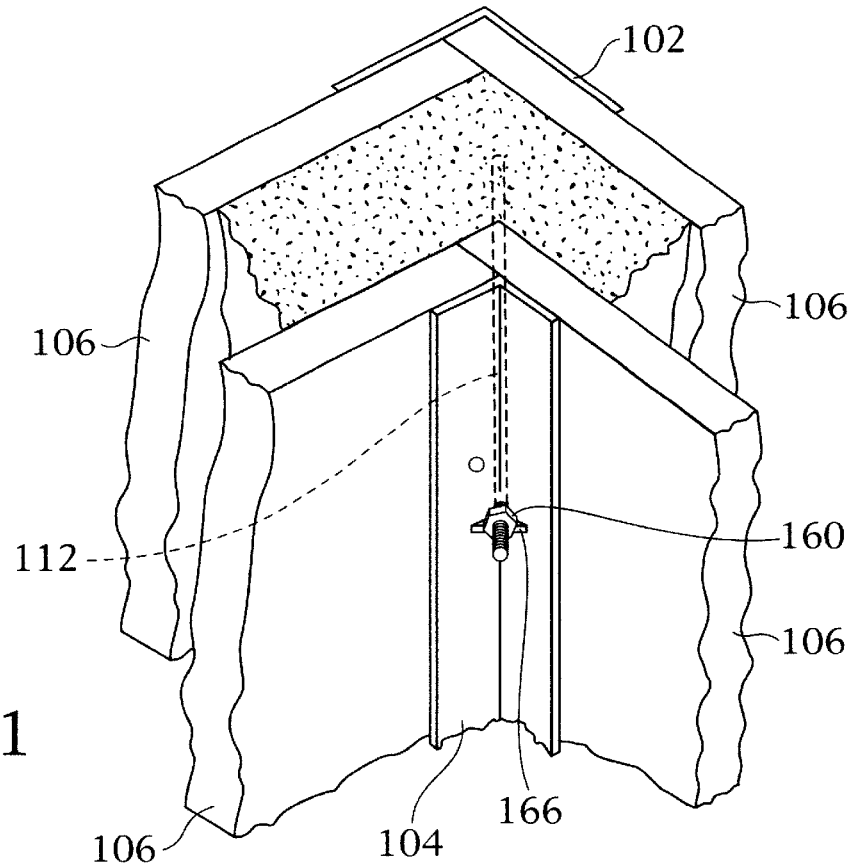
FIG. 21 is a perspective view from the interior of the construction showing the corner assembly.

In order to assist in adjusting the corner assemblies 100 to assure the tolerances of the construction, it is desirable to form a plate 158 at the base of the corner assembly 100 as shown in FIGS. 17–19. Preferably, the second member 104 may be a right angle metal section of a selected length. The plate 158 is connected to the lower end of the second member 104 and anchored to the floor or base of the construction. In this position, the plate acts as a pivot point for minor adjustments required to maintain the entire corner and corner assembly 100 in a plumb condition. A plate 158 may also be connected to the upper end of the second member 104. In this manner, two or more second members 104 may be abutted and connected end to end to form a member having a desired height which has increased stability and rigidity. A U-shaped clip 162 is secured to the second member 104 at a selected height above the foot plate 158. Preferably, the clip 162 has an opening formed in each leg of the U-shape. An adjustable brace 164 is connected between the U-shaped clip 162 and the floor to provide fine adjustments to the alignment of the corners (FIG. 20). The brace 164 is used to support the second member 104 during the construction phase and is removed when no longer required. The brace 164 may be a single unit but preferably has a turnbuckle to more easily adjust the length of the brace 164 as required to adjust the plumb of the construction.

Also, as shown in FIG. 16, a shelf 166 having a triangular shape is disposed in the bend of the second member 104 juxtapositioned to the bridge 112. The fastener 160 is tightened against the side of the triangular shelf 166 to wedge the shelf 166 within the bend in the second member 104 to further stabilize the construction.

The first member 102 of most of the embodiments is easily formed from sheet metal. The thickness (gauge) of the sheet metal is selected based on the strength anticipated by the construction. The corner assembly is not temperature sensitive and the metal members are fire proof. The corner assembly may be formed into any desired angle and the members may be spaced apart by any desired distance. The tie bars to provide support are inexpensive and can be easily formed to any desired length required by the peculiarities of the construction. Even within the same construction, a variety of angles and thickness of walls and corners can be formed. The components can be formed at a location distant from the construction site and easily and economically transported to the site because the components may be nested or stacked conveniently. The corner assembly can be assembled by persons having a relatively low level of skills. Little or no adaptation of standard panels is required.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A corner assembly for concrete form panels comprising:

a pair of rigid members, each member having an inner face and a bend therein forming a selected dihedral angle, the rigid members being spaced apart by a selected distance, the inner faces of the rigid members being oriented in a same direction, the pair of rigid members each having a height ranging from six inches to eight feet, at least one connector disposed along the height of the pair of rigid members only between the respective bends in the pair of rigid members, at least one concrete form panel comprising a prefabricated plastic panel juxtapositioned, and connected to each of the rigid members, wherein the concrete form panels may be spaced apart a varying distance, even within a same construction, forming cavities of differing thicknesses, concrete being disposed adjacent to each of the at least one concrete form panels, and the corner assembly retaining the concrete form panel without external bracing and without risk of sag, deformation, separation or blow-out of the corner assembly.

2. The corner assembly of claim 1, wherein the members each have at least one inwardly lanced-out eyelet at the bend of the respective member, the bridge having a length and right angle ends, the ends of the bridge being received in the respective eyelet of the spaced-apart members such that the spaced-apart members are secured apart at a distance equal to the length of the bridge.

3. The corner assembly of claim 2, wherein two pairs of spaced-apart members are provided, an outer pair and an inner pair spaced apart from the outer pair, at least one concrete form panel being disposed between the outer pair of members and at least another concrete panel disposed between the inner pair of members, the outer pair of members being connected to the inner pair of members by a removable tie rod, and concrete being disposed between the inner pair of members and the outer pair of members.

4. The corner assembly of claim 1, wherein at least a portion of an outer face of the corner assembly is colored.

5. The corner assembly of claim 1, wherein the at least one rigid member is formed from metal.

6. The corner assembly of claim 1, wherein the at least one rigid member has a selected height.

7. The corner assembly of claim 1, wherein the at least one concrete form panel is a polystyrene block.

8. The corner assembly of claim 1, wherein one of the members is formed from a pair of submembers, the pair of submembers being contiguous and mechanically joined.

9. A corner assembly for concrete form panels comprising:

a pair of rigid members, each member having an inner face and a bend therein forming a selected dihedral angle, the rigid members being spaced apart by a selected distance, a removable bridge disposed between the pair of rigid members, at least one concrete form panel juxtapositioned, and connected to each of the rigid members and concrete is disposed adjacent to each of the at least one concrete form panel, the corner assembly retains the concrete form panel without external bracing and without risk of sag, deformation, separation or blow-out of the corner assembly, wherein the members each have at least one inwardly lanced-out eyelet at the bend of the respective member, the bridge having a length and right angle ends, the ends of the bridge being received in the respective eyelet of the spaced-apart members such that the spaced-apart members are secured apart at a distance equal to the length of the bridge, wherein two pairs of spaced-apart members are provided, an outer pair and an inner pair spaced apart from the outer pair, at least one concrete form panel being disposed between the outer pair of members and at least another concrete form panel disposed between the inner pair of members, the outer pair of members being connected to the inner pair of members by a removable tie rod, and concrete being disposed between the inner pair of members and the outer pair of members, and wherein the dihedral angle of the first pair of members is different from the dihedral angle of the second pair of members.

10. A corner assembly for concrete form panels comprising:

a pair of rigid members, each member having an inner face and a bend therein forming a selected dihedral angle, the rigid members being spaced apart by a selected distance, a removable bridge disposed between the pair of rigid members, at least one concrete form panel juxtapositioned, and connected to each of the rigid members and concrete is disposed adjacent to each of the at least one concrete form panel, the corner assembly retains the concrete form panel without external bracing and without risk of sag, deformation, separation of blow-out of the corner assembly, and further comprising a removable supporting means disposed vertically within the corner assembly to provide vertical support to the corner assemblies, a horizontal plate being formed at a base of the supporting means to anchor the corner assembly to a foundation surface and to act as a pivot point for minor adjustments.

11. A corner assembly for concrete form panels comprising:

a pair of rigid members, each member having an inner face and a bend therein forming a selected dihedral angle, the rigid members being spaced apart by a selected distance, wherein the first rigid member is formed from a first submember and a second submember, each submember having a longer side and a shorter side, there being a selected acute angle between the longer side and the shorter side, the shorter sides of the submembers abutting and connecting to one another such that the longer sides form an outer corner, a first concrete panel form having a side formed at the selected acute angle being disposed adjacent to the selected acute angle of the first submember, a second concrete panel form having a side formed at a selected acute angle being disposed adjacent to the selected acute angle of the second submember such that the selected acute angle sides of the first concrete form panel cooperates with the selected acute angle side of the second concrete form panel and the concrete form panels are disposed side by side to one another interiorly of the longer sides of the respective submembers, wherein the a second rigid member is formed from a first submember and a second submember, each submember having a longer side and a shorter side, there being a selected obtuse angle between the longer side and the shorter side, the shorter sides of the submembers abutting and connected to one another, the longer sides forming an inner corner, a third concrete panel form having a side formed at the selected obtuse angle being disposed adjacent to the selected obtuse angle of the first submember, a fourth concrete panel form having a side formed at the selected obtuse angle being disposed adjacent to the selected obtuse angle of the second submember such that the respective selected obtuse angle side of the third concrete form panel cooperates with the selected obtuse angle side of the fourth concrete form panel and the concrete form panels are disposed side by side to one another, the second rigid member being spaced apart from the first rigid member by a selected distance, the shorter sides of the first rigid member and the shorter sides of the second rigid member have respective openings formed therein, at least one tie rod having bent ends and a length corresponding to the distance between the spaced-apart first and second rigid members, the at least one tie rod being disposed between the first and second rigid members, the bent ends of the at least one tie rod being received in the openings in the shorter sides of the respective rigid members such that the first rigid member is connected to the second rigid member, and concrete disposed between the concrete form panels adjacent to the first rigid member and the second rigid member, such that the corner assembly retains the concrete form panel without external bracing and without risk of sag, deformation, separation or blow-out of he corner assembly.

12. In a form assembly used for concrete construction, wherein the concrete is poured between spaced-apart plastic form panels, the form panels being retained during the pouring of the concrete, the improvement comprising a metal corner assembly having two pairs of metal members spaced apart a preselected distance, including an inner pair and an outer pair of bent sheet metal members, each pair of bent sheet metal members including a first metal submember and a second metal submember on opposite sides of the bend, plastic form panels being juxtapositioned to the sheet metal members, fasteners driven through at least the first submember and the second submember of the outer sheet metal member and into the respective juxtapositioned plastic form panels, such that plastic form panels may be received within the respective first and second metal members and retained thereby during the pouring of the concrete into the space between the respective pairs of metal members.

13. The improvement of claim 12, wherein the plastic form panels comprise polystyrene blocks.

14. A corner assembly for concrete form prefabricated plastic panels comprising:

a pair of rigid members, each member having an inner face and a bend therein forming a selected dihedral angle, the rigid members being spaced apart by a selected distance, a plurality of spaced-apart tie-in openings being formed in the rigid members, at least one concrete form prefabricated plastic panel juxtapositioned to each of the rigid members, at least one elongated shank being received in at least one of the tie-in openings and extending therethrough into the at least one concrete form prefabricated plastic panel transversely thereof to secure the rigid member to the at least one concrete form prefabricated plastic panel, an adjustable diagonal connector member connecting the pair of rigid members, liquid fill being disposed adjacent to each of the at least one concrete form prefabricated plastic panels, and the corner assembly retains the concrete form prefabricated plastic panel without external bracing and without risk of sag, deformation, separation or blow-out of the corner assembly.

15. The corner assembly of claim 14, wherein the tie-in openings are countersunk such that the at least one elongated shank is flush with the at least one rigid member.

16. The corner assembly of claim 14, wherein the rigid members are each formed from a single sheet.

17. In the method of constructing at least one pair of intersecting concrete walls, between respective spaced-apart pairs of prefabricated plastic form panels assembled at a job site, wherein the concrete being poured between the respective pairs of prefabricated plastic form panels creates a stress concentration at the corner, thereby tending to blow out the corner during pouring of the concrete, and thereby requiring external bracing to prevent a blow out at the corner as the concrete is being poured, the improvement comprising the step of providing at least one bent sheet metal reinforcement for the prefabricated plastic form panels at the intersecting corner therebetween, the at least one bent sheet metal reinforcement having respective side plates forming a bend having a dihedral angle therebetween that may be selected easily and conveniently without incurring substantial mold charges, such that the external bracing may be minimized or eliminated altogether, and such that the at least one bent sheet metal reinforcement may have any desired height to accommodate a single corner or a plurality of corners spaced vertically with respect to each other, further including the steps of connecting the pair of rigid members with an adjustable diagonal connector and providing holes in the respective side plates of the at least one bent sheet metal reinforcement and driving elongated shanks through the holes in the side plates of the at least one bent sheet metal reinforcement and transversely into the respective prefabricated plastic form panels.

18. The method of claim 17, further comprising forming the at least one bent sheet metal reinforcement from a single sheet of metal.

19. In a form used for concrete construction, wherein concrete is poured between plastic form panels, a corner support assembly comprising:

at least a unitary outer rigid member and a spaced-apart unitary inner rigid member, each rigid member being flat and bent into a desired dihedral angle, thereby forming a bend in each member, and defining a first portion and a second portion on opposite sides of the respective bends, the bend in the outer rigid member being oriented similarly to the bend in the inner rigid member, the unitary outer rigid member having an outer face and an opposite inner face, the unitary inner rigid member having an outer face distal from the outer face of the outer rigid member and an inner face proximal to the inner face of the outer rigid member, a bridge being connected between only the respective bends of the rigid members, a first plastic form panel being disposed adjacent to the first portion on the inner face of the outer rigid member, a second plastic form panel being disposed adjacent to the second portion on the inner face of the outer rigid member such that the first plastic form panel adjoins the second plastic form panel at the bend in the outer rigid member, a third plastic form panel being disposed adjacent to the first portion on the inner face of the inner rigid member, a fourth plastic form panel being disposed adjacent to the second portion on the inner face of the inner rigid member such that the third plastic form panel adjoins the fourth plastic form panel at the bend in the inner rigid member, at least one fastener passing transversely through the first portion of the outer rigid member into the first plastic form panel and at least another fastener passing transversely through the second portion of the outer rigid member into the second plastic form panel, wherein modification of the form panels is not required, and maximum strength of the corner support assembly is provided consonant with versatility and minimum cost of labor and materials.

20. The corner support of claim 19, wherein the outer rigid member has a height ranging from six inches to eight feet.

21. The corner support assembly of claim 19, wherein the joining of the first and second plastic form panel has a diagonal thickness, the joining of the third and fourth plastic form panel has a diagonal thickness, the concrete has a diagonal thickness defined by the spacing between the outer rigid member and the inner rigid member, and the bridge has a length equal to the sum of the diagonal thickness of joining of the first and second plastic form panels plus the diagonal thickness of the joining of the third and fourth plastic form panels plus the diagonal thickness of the concrete, wherein the length of the bridge is adjustable.

* * * * *